US007289392B2

(12) United States Patent
Burkhardt et al.

(10) Patent No.: US 7,289,392 B2
(45) Date of Patent: Oct. 30, 2007

(54) DATE DISPLAY ASSEMBLY FOR A TIMEPIECE

(75) Inventors: Wolfgang Burkhardt, Ispringen (DE); Herbert Schwartz, Wurmberg (DE)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 11/453,520

(22) Filed: Jun. 14, 2006

(65) Prior Publication Data

US 2006/0285444 A1 Dec. 21, 2006

Related U.S. Application Data

(60) Provisional application No. 60/691,913, filed on Jun. 17, 2005.

(51) Int. Cl.
*G04B 19/20* (2006.01)
*G04B 19/24* (2006.01)

(52) U.S. Cl. ..... 368/37

(58) Field of Classification Search ..... 368/28, 368/35–38

See application file for complete search history.

(56) References Cited

U.S. PATENT DOCUMENTS

| | | | | |
|---|---|---|---|---|
| 4,676,659 A | | 6/1987 | Vuilleumier | |
| 6,081,483 A | * | 6/2000 | Capt et al. | 368/28 |
| 6,574,167 B2 | * | 6/2003 | Weissbach et al. | 368/35 |
| 7,031,227 B2 | * | 4/2006 | Huter | 368/37 |
| 2003/0193840 A1 | | 10/2003 | Huter | |
| 2005/0174891 A1 | * | 8/2005 | Besse | 368/37 |
| 2005/0286348 A1 | * | 12/2005 | Cleusix et al. | 368/37 |

FOREIGN PATENT DOCUMENTS

| | | |
|---|---|---|
| EP | 0 218 926 | 4/1987 |
| EP | 0 940 833 | 9/1999 |
| EP | 1 460 494 | 9/2004 |
| WO | 99/13383 | 3/1999 |

OTHER PUBLICATIONS

Photograph of prior art gearing mechanism of a Timex watch (see IDS for additional explanation).

* cited by examiner

*Primary Examiner*—Vit W. Miska
(74) *Attorney, Agent, or Firm*—Carmody & Torrance LLP

(57) ABSTRACT

A date display assembly for an electronic device, the assembly comprising a ones date ring assembly, a tens date disc assembly and a gear assembly comprising a four-legged blocking star and a four-legged driving star, wherein the driving star is used for driving the tens disc and the blocking star is used to maintain the proper orientation of the tens disc.

8 Claims, 1 Drawing Sheet

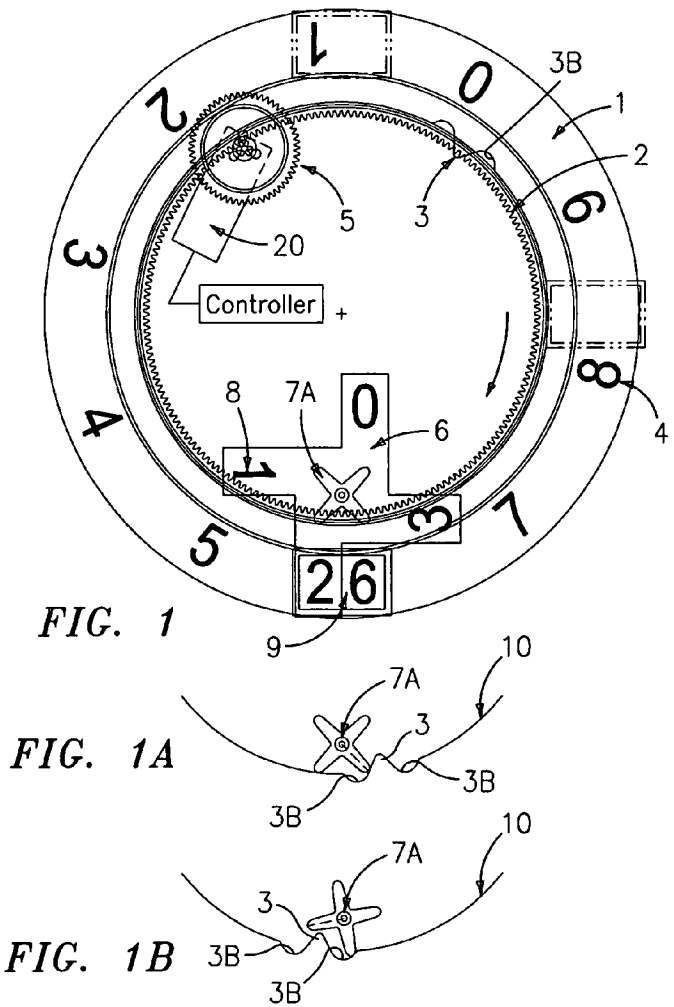
FIG. 1
FIG. 1A
FIG. 1B
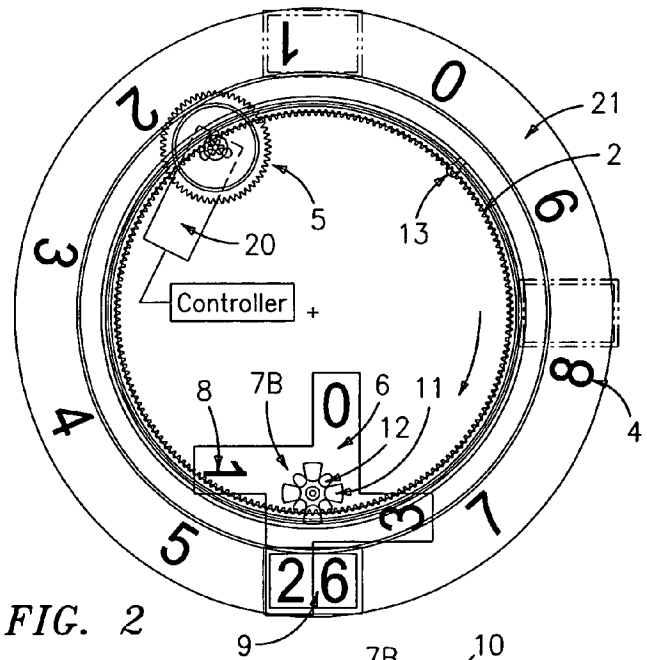
FIG. 2
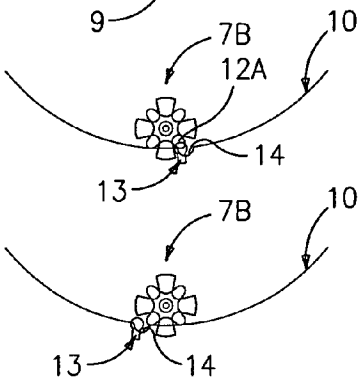
FIG. 2A
FIG. 2B

DATE DISPLAY ASSEMBLY FOR A TIMEPIECE

RELATED APPLICATIONS

This application claims the benefit of U.S. Provisional Application No. 60/691,913, filed Jun. 17, 2005.

BACKGROUND OF THE INVENTION

The present invention relates generally to timepieces, such as wristwatches, and in particular, to improved constructions and methodologies for maintaining accurate date information in such timepieces that comprise date rings. Typically timepieces referred to as "analog" or "quartz-analog" watches having hands for displaying time, and which drive the date rings as a function of the rotation of one or more gears, are applicable to this invention. In particular, the present invention provides an improved construction and methodology for maintaining an accurate date display using one date wheel to display the "ones" portion of the date reading and another date wheel to display the "tens" portion of the date reading. A two wheeled date display in this regard allows for the use of larger numbers and easier reading.

U.S. Patent Application Publication No. U.S. 2003/0193840 describes such a two-ringed date display system, wherein a motor and gearing system turn both the "ones" disc and the "tens" disc. In such an embodiment, the tens ring rotates 360° with each date increment of the ones ring, and the tens disc rotates 450° with each increment of the ones ring going from "9" to "0." It is believed that this arrangement requires an unnecessarily amount of rotation of the tens disc.

The present invention is therefore preferably directed to a date display for an electromechanical timepiece which will be simple, requiring few pieces which are easily machined and whose reading will be easily seen because of the relatively large size of the numbers used. In addition, necessary motion of the mechanism is minimized thereby conserving energy. These and other objects of this invention will be revealed in the construction disclosed herein.

SUMMARY AND OBJECTIVES OF THE INVENTION

It is thus an objective of the present invention to provide an improved date display assembly that overcomes the perceived deficiencies in the prior art.

Another objective of the present invention to provide an improved date display assembly that allows for a maximization of the printable area for a multi (e.g. 4) segment tens-disc.

Still another objective of the present invention to provide an improved date display assembly that provides for accurate and reliable driving angles for the driving mechanism that drives the tens disc. Specifically, it is an objective of the present invention to ensure optimization of the driving angle (e.g. 90°) of the gear assembly that drives the tens disc.

Yet another objective of the present invention is to minimize the need for additional parts, such as detent spring(s) and intermediate wheels, thereby improving the reliability of the date display assembly and reducing manufacturing, inventory and construction costs.

Further objects and advantages of this invention will become more apparent from a consideration of the drawings and ensuing description.

The invention accordingly comprises the features of construction, combination of elements and arrangement of parts that will be exemplified in the disclosure hereinafter set forth, and the scope of the invention will be indicated in the claims.

To overcome the perceived deficiencies in the prior art and to achieve the objects and advantages set forth above and below, the present invention is, generally speaking, directed to a date display assembly for an electronic device, the assembly comprising a motor and a first gear assembly operatively coupled thereto, wherein the gear assembly comprises at least one rotating gear and the motor causes the rotation of the first gear assembly; a ones date ring assembly comprising a ones date ring comprising numerals from 0 to 9 on the face thereof, gear teeth meshingly alignable with the first gear assembly; a finger extending from the ones date ring; and a non-toothed inner circumferential surface in a plane different from the plane of the gear teeth, wherein the inner circumferential surface comprises a recess; a tens date disc assembly comprising a tens date disc having numerals at least from 1 to 3 on the face thereof; a second gear assembly comprising a four-legged blocking star and a four-legged driving star both of which are coupled to each other in facing alignment, wherein the blocking star is located in the plane of the non-toothed inner circumferential surface and the driving star is located in the plane of the finger, wherein the blocking star is blocked from rotation unless a leg is positioned in the recess, and the legs of the blocking star are dimensioned so that the blocking star cannot rotate when blocked by the inner circumferential surface; and a display area that selectively displays one date ring numeral from the ones date ring and one date disc numeral from the tens date disc; wherein when the first gear assembly rotates the ones date ring to cause the ones date ring numeral displayed in the display area to change between the 9 and 0 numerals, the finger engages a leg of the driving star while one of the legs of the blocking star previously blocked from rotation by the inner circumferential surface is received in the recess, thereby (i) forcing the rotation of the driving star in one of the clockwise and counterclockwise directions and (ii) simultaneously permitting the rotation of the blocking star in the same direction as the rotation of the driving star; whereby (i) the tens date disc rotates by at least essentially 90° each time the ones date ring is rotated by at least essentially 360° and (ii) the tens date disc cannot rotate until the numeral on the ones date ring in the display area is changing between the 9 and 0 numerals.

BRIEF DESCRIPTION OF THE DRAWINGS

FIG. 1 is a top plan view of one configuration of the present invention, although being illustrated to show the deficiencies therein and to highlight the preferred construction set forth in FIGS. 2, 2A and 2B;

FIGS. 1A and 1B show a gear assembly in various positions of rotation;

FIG. 2 shows a top plan view of the preferred configuration of the date display assembly constructed in accordance with the present invention, wherein among other things, gear 7A has been replaced by an improved gear assembly generally indicated at 7B; and FIGS. 2A and 2B illustrate the gear assembly of the present invention in various positions of rotation in accordance with the present invention.

DETAILED DESCRIPTION OF THE INVENTION

Before turning to the preferred embodiment of the invention which is set forth in FIGS. 2, 2A and 2B, reference is first made to FIGS. 1, 1A and 1B to highlight one potential, although less than optimal embodiment, of the present invention.

Specifically, the date display assembly depicted in FIG. 1 comprises a ones date ring 1 comprising gear teeth 2 meshingly engageable with a first gear 5 and having date ring numerals 4 printed on a face thereof, a tens date disc 6 comprising date disc numerals 8 printed on the face thereof and gear 7A (in the shape of a four-legged star) coupled to the tens date disc.

A motor, generally indicated at 20, is rotatably coupled to a gearing assembly comprising at least one gear (e.g. gear 5). Motor 20 is preferably a stepping motor and has a rotating rotor that is operatively coupled to the gearing assembly comprising gear 5. Such a construction is well within the purview of the skilled artisan. For example, U.S. patent application Ser. No. 10/716,011, which is hereby incorporated by reference as if fully set forth herein, illustrates a stepping motor for rotating a gearing assembly that itself rotates the ones date ring. The motor is constructed to advance the gearing assembly (e.g. gear 5) such that ones date ring 1 rotates to expose the next sequential date ring numeral 4 in the display area 9 each twenty-four hour period. The electronic control circuit that controls motor 20 is preferably provided to take into account the months comprising 28, 30 and 31 days respectively, as well as leap years. It is believed to be within the skill in the art to design the size and tooth structure of gear 5 and gear teeth 2 such that it will meshingly couple with the gear teeth 2 of ones date ring 1 and rotate date ring 1 in steps so as to sequentially reveal the numerals 4 on the face of first date ring 1 in the display area 9 for each successive day.

The ones date ring 1 comprises date ring numerals 4 from zero to nine printed on the face thereof. The date ring numerals 4 are preferably evenly spaced around the circumference of date ring 1, thereby allowing an even rotation of date ring 1 by 36° to sequentially expose each successive date ring numeral 4 in display area 9. Preferably gear teeth 2 are positioned along the inner circumference of first date ring 1.

Tens date disc 6 comprises the date disc numerals 8 from zero to three printed on its face, although the numeral "0" could be replaced with a blank space. The date disc numerals 8 are preferably equally spaced such that a 90° rotation of tens date disc 6 reveals the next successive date disc numeral 8 in the display area 9. Tens date disc 6 is preferably in the shape of an offset cross as shown in FIGS. 1 and 2. Such an offset cross shape allows for convenient positioning of date disc 6 as well as for the efficient display of date disc numerals 8 in the display area 9 without any interference with the first date ring 1.

In this less than optimal embodiment, the display assembly comprises a gear 7A, which is illustrated to be in the form of a four-legged star. As illustrated in FIGS. 1, 1A and 1B, when protrusion 3 contacts gear 7A, gear 7A will be urged to rotate in the direction urged by the protrusion (e.g. clockwise as illustrated in FIGS. 1A and 1B). To allow for the rotation of gear 7A in either the clockwise or counter-clockwise direction, two recesses 3B are provided, one on each side of protrusion 3. These recesses allow for the rotation of gear 7A when urged by protrusion 3. Specifically, it is clear that the legs of gear 7A need additional clearance when being rotated, such clearance being provided by recesses 3B. When not received in the recesses, it can be seen that gear 7A is blocked from rotation from the contact of the legs with the inner circumferential surface of ring 1.

Although at first glance, the embodiment of FIG. 1 may appear satisfactory, it is less than fully desirable. For example, the legs of single gear 7A must provide both the blocking function and the driving function. FIG. 1A demonstrates the beginning of the driving situation, but fully highlights the disadvantageous pressure angle between protrusion 3 and the leg that engages protrusion 3. Specifically, it can be seen that there is an appreciable risk that the angle as protrusion 3 engages the leg will be too steep for rotation, thus increasing the likelihood of a less than reliable rotation of gear 7A. Additionally, and which is highlighted in FIG. 1B, at the end of the rotation of gear 7A by protrusion 3, gear 7A has actually rotated more than 90° and in fact, has rotated 180° (compare dashed lines illustrated in gear 7A between FIGS. 1A and 1B). Thus, it can be seen that the embodiment of FIG. 1 provides less than desirable and less than reliable results.

However, it has been realized that improved reliability can be ensured by an assembly that comprises both a driving gear and a blocking gear, hereinafter conveniently referred to and be interchangeable with the term "stars."

For example, in the preferred embodiment of FIG. 2, ones date ring 21 comprises a (preferably) smooth inner circumferential surface 10 in a plane parallel to, but above or below, the plane of gear teeth 2. The preferably smooth inner circumferential surface also comprises a recess 14, preferably located on the smooth inner circumferential surface between numerals zero and nine. In addition, gear assembly 7B comprises two, four legged stars 11, 12, a first of which is located in a plane parallel to but above or below the plane of the other star and preferably coupled together in face-to-face alignment. Preferably, the legs of the stars are offset from each other by 45°.

In this preferred embodiment, when first date ring 1 rotates (in a manner consistent with the rotation set forth above with respect to FIG. 1) such that the numeral 4 shown in display area 9 changes from nine to zero, finger 13 engages one of the legs of star 11 (called the "driving star") to thereby force the rotation of driving star 11 in the clockwise direction. At about the same time, the trailing leg 12*a* of star 12 (e.g. the "blocking star") is received in recess 14 to provide the clearance to permit the rotation of blocking star 12 in the same direction as the rotation of driving star 11. Preferably, star 12 of gear assembly 7B is located in the same plane as that of the smooth inner circumferential surface 10 and in such a position that one or more (preferably two) of the legs of blocking star 12 will touch (e.g. be in contact with or at the least be in very close proximity to) the smooth inner circumferential surface 10 thereby blocking rotation of star 12 during all other rotation of ones date ring 21 unless and until recess 14 is positioned to receive the trailing leg thereof. On the other hand, driving star 11 is preferably located in a plane parallel to but above or below the plane of the first star 12 and the smooth inner circumferential surface 10, and preferably in the same plane as finger 13. This preferred arrangement blocks gear assembly 7B (and tens date disc 6) from rotating unintentionally unless recess 14 is in position to receive a leg of blocking star 12 to allow the leg to rotate past the smooth inner circumferential surface 10.

The display area 9 is designed to display one date ring numeral 4 from ones date ring 1 and one date disc numeral 8 from date disc 6 side by side, with the numeral 8 from date disc 6 appearing to the left of date ring numeral 4 from the first date ring 1 as viewed from the top.

In accordance with the preferred construction, during the first nine days of a month the display area 9 will display the zero (or a blank) on the date disc while date ring numerals 4 on the first date ring 1 rotate through the display area 9 from one to nine with each successive numeral from one to nine displayed in display area 9 on each successive day. This is accomplished by rotating the first date ring 1 by 36° once each day. On the tenth day when the first date ring 1 rotates 36°, finger 13 will drive a leg of driving star 11 thereby rotating the tens date disc 6 by 90° and displaying the numeral "1" in the display area 9 adjacent to the numeral, zero, from the first date ring 1. The same process will repeat for days 11 through 20 and 21 through 31. At the end of a month of 31 days the motor may be programmed to rotate the ones date ring 1 sufficiently so that a "01" appears in the display area. In the case of a 30 day month, 28 day month, or leap year, the motor is programmed to rotate similarly. These programmed variations in rotating the date ring 1 at the end of the month will automatically reset the position of the date disc 6 back to zero or blank for the beginning of the next month. This functionality is accomplished by programming a controller that will drive motor 20 to provide an annual/perpetual calendar using the mechanism described herein. Also, to assist in some of the microprocessor and other functions, although not believed to be critical to an understanding of the present invention, the disclosure of application Ser. No. 10/716,011 is incorporated by reference as if fully set forth herein.

As can now be seen, this second embodiment is superior to the first mentioned embodiment of FIG. 1 because, among other things, the driving legs of driving star 11 will always be aligned essentially at right angles to finger 13, thereby providing optimum pressure/driving angles. For example, FIG. 2B shows the end of the driving situation, wherein the driving angle remains 90° for optimized driving, and the similar rotation angle of only 90° for the legs of blocking star 12 is likewise acceptable.

Lastly, one skilled in the art should fully realize that the construction of FIG. 2 is optimized for rotation of the ones date ring 1 in a clockwise direction. However, to fully appreciate the present invention, it would be desirable to make the finger/recess configuration symmetrical so that rotation of the ones date ring 1 in the counterclockwise direction also provides for acceptable driving of star 11 in the counterclockwise direction. Such a construction will allow for the full appreciation of a bi-directional motor and a date ring 1 that can be rotated in both clockwise and counterclockwise direction.

It can thus be seen that the present invention provides numerous advantages not found in the prior art. For example, the present invention provides an improved date display assembly that allows for a maximization of the printable area for a multi (e.g. 4) segment tens-disc. Additionally, the present invention provides for accurate and reliable driving angles for the driving mechanism that drives the tens disc. Still further, the present invention minimizes the need for additional parts, such as detent spring(s) and intermediate wheels, thereby improving the reliability of the date display assembly and reducing manufacturing, inventory and construction costs.

While the invention has been particularly shown and described with respect to preferred embodiments thereof, it will be understood by those skilled in the art that changes in form and details may be made therein without departing from the scope and spirit of the invention.

Furthermore, by reference to "ring" or "disc" or other shapes, it should be understood that the shape of the structure referenced by numeral 6 (i.e. an offset cross) in the figures is covered thereby. Therefore, use of the term "ring" or "disc" is specifically meant to include (but not limited to) such an offset cross shape.

What is claimed is:

1. A date display assembly for an electronic device, the assembly comprising:

a motor and a first gear assembly operatively coupled thereto, wherein the gear assembly comprises at least one rotating gear and the motor causes the rotation of the first gear assembly;

a ones date ring assembly comprising:

a ones date ring comprising numerals from 0 to 9 on the face thereof, gear teeth meshingly alignable with the first gear assembly;

a finger extending from the ones date ring; and a non-toothed inner circumferential surface in a plane different from the plane of the gear teeth, wherein the inner circumferential surface comprises a recess;

a tens date disc assembly comprising:

a tens date disc having numerals at least from 1 to 3 on the face thereof;

a second gear assembly comprising:

a four-legged blocking star and a four-legged driving star both of which are coupled to each other in facing alignment, wherein the blocking star is located in the plane of the non-toothed inner circumferential surface and the driving star is located in the plane of the finger;

wherein the blocking star is blocked from rotation unless a leg is positioned in the recess, and the legs of the blocking star are dimensioned so that the blocking star cannot rotate when blocked by the inner circumferential surface; and a display area that selectively displays one date ring numeral from the ones date ring and one date disc numeral from the tens date disc;

wherein when the first gear assembly rotates the ones date ring to cause the ones date ring numeral displayed in the display area to change between the 9 and 0 numerals, the finger engages a leg of the driving star while one of the legs of the blocking star previously blocked from rotation by the inner circumferential surface is received in the recess, thereby (i) forcing the rotation of the driving star in one of the clockwise and counterclockwise directions and (ii) simultaneously permitting the rotation of the blocking star in the same direction as the rotation of the driving star;

whereby (i) the tens date disc rotates by at least essentially 90° each time the ones date ring is rotated by at least essentially 360° and (ii) the tens date disc cannot rotate until the numeral on the ones date ring in the display area is changing between the 9 and 0 numerals.

2. The date display assembly as claimed in claim 1, wherein the finger and the recess are located between numerals 9 and 0 on the ones date ring.

3. The date display assembly as claimed in claim 1, wherein the tens date disc is in the shape of an offset cross.

4. The date display assembly as claimed in claim 1, wherein the four-legged blocking star and the four-legged driving star are aligned 45° offset from each other.

5. The date display assembly as claimed in claim 4, wherein the combination of the recess, the inner circumference surface and the finger provide for the rotation of the driving star only in increments of at least essentially 90° and for the rotation of the blocking star only in increments of at least essentially 90°.

6. The date display assembly as claimed in claim 1, wherein the electronic device is a wristwatch.

7. A date display assembly for an electronic device, wherein the assembly is driven by a motor and a first gear assembly operatively coupled thereto, wherein the gear assembly comprises at least one rotating gear and the motor causes the rotation of the first gear assembly, wherein the assembly comprises:

a ones date ring assembly comprising:

a ones date ring comprising numerals from 0 to 9 on the face thereof, gear teeth meshingly alignable with the first gear assembly;

a finger extending from the ones date ring; and a non-toothed inner circumferential surface in a plane different from the plane of the gear teeth, wherein the inner circumferential surface comprises a recess;

a tens date disc assembly comprising:

a tens date disc having numerals at least from 1 to 3 on the face thereof;

a second gear assembly comprising:

a blocking star and a driving star both of which are coupled to each other in facing alignment, wherein the blocking star is blocked from rotation unless a portion thereof is received in the recess; and a display area that selectively displays one date ring numeral from the ones date ring and one date disc numeral from the tens date disc;

wherein upon rotation of ones date ring, the finger engages the driving star while a portion of the blocking star is received in the recess thereby (i) forcing the rotation of the driving star in one of the clockwise and counterclockwise directions and (ii) simultaneously permitting the rotation of the blocking star in the same direction as the rotation of the driving star;

whereby (i) the tens date disc rotates by at least essentially 90° each time the ones date ring is rotated by at least essentially 360° and (ii) the tens date disc cannot rotate until the numeral on the ones date ring in the display area is changing between the 9 and 0 numerals.

8. The date display assembly as claimed in claim 7, wherein the electronic device is a wristwatch.

* * * * *